United States Patent [19]

Blackwell

[11] 4,254,962

[45] Mar. 10, 1981

[54] SWAB CUP HAVING LONG AND SHORT REINFORCING MEMBERS

[75] Inventor: Henry W. Blackwell, Venus, Tex.

[73] Assignee: Dresser Industries, Inc., Dallas, Tex.

[21] Appl. No.: 60,247

[22] Filed: Jul. 25, 1979

[51] Int. Cl.[3] ..... F16J 1/04; F16J 15/56

[52] U.S. Cl. ..... 277/181; 277/212 C; 92/241

[58] Field of Search ..... 92/241, 254, 194, 195, 92/240; 166/202; 277/149, 235 R, 164, 165, 181, 182, 186, 212 C, 212 R

[56] References Cited

U.S. PATENT DOCUMENTS

| | | | |
|---|---|---|---|
| 2,581,981 | 1/1952 | Taylor | 277/212 C X |
| 2,723,721 | 11/1955 | Corsette | 277/212 C X |
| 3,677,143 | 7/1972 | Crickmer | 92/241 |
| 4,099,451 | 7/1978 | Blackwell | 277/212 C X |

*Primary Examiner*—Robert S. Ward, Jr.

*Attorney, Agent, or Firm*—J. N. Hazelwood; W. R. Peoples

[57] ABSTRACT

A well swab cup has an annular bushing for supporting a plurality of longitudinally extending wire reinforcing members within an elastomeric cup like body. The reinforcing members are supported in a base cup around the lower portion of the bushing and extend upward to a mid-portion of the body. Approximately one half of the reinforcing wire members extend the full length of the swab cup and the others terminate at a mid-point of the swab cup's length within its elastomeric body.

5 Claims, 3 Drawing Figures

SWAB CUP HAVING LONG AND SHORT REINFORCING MEMBERS

TECHNICAL FIELD

This invention is related to well swab cup internal constructions. More specifically, the invention is related to swab cup internal constructions which have both long and short swab cup reinforcing members or wires within the elastomeric cup like body.

BACKGROUND OF THE INVENTION

The ability of a swab cup to pick up light loads as well as heavy loads depends upon the cup's ability to deform in accordance with the operating load conditions. For light load operation, the swab cup must deform with less force or fluid weight acting on the cup than is present during heavy load operation. In light load operation, the swap cup's upper portion must deform under the light weight load to contact the tubing interior wall so the swab cup can pick up and transport well fluid in the tubing. In heavy load operation, the upper and the lower portions of the swab cup must deform to carry the heavier load and circumferentially expand the swab cup to seal against the tubing interior so the swab cup can transport the well fluid without leakage.

In prior swab cup constructions, those having single length wire reinforcing members, have a tendency to be rather stiff thus do not pick up or retain the lighter loads. Some prior swab cup constructions have two lengths of wire reinforcing members and additionally have an elastomeric lip extending substantially beyond the wire reinforcing members to seal in very light loading conditions. While this later construction may pick up light loads of well fluid, it is a significantly longer swab cup than the others and is prone to damage of the unsupported or unreinforced upper portion of the swab cup body.

SUMMARY OF THE INVENTION

In an embodiment, a swab cup structure includes an elastomeric cup like body containing an annular U-shaped base cup in its lower end portion with a plurality of wires or reinforcing members mounted around the interior of the base cup and extending upward. A portion of the reinforcing members or wires extend to the upper end of the swab cup and the remainder terminate at a mid-portion of the swab cup's length. The shorter length wire members are curved inward in their upper end portion and are enclosed in the elastomeric swab cup body while the uppermost end portion of the longer wires extends above the main portion of the elastomeric swab cup body. Light loads deform the upper portion of the swab cup where fewer wires are located while heavier loads can be carried by the lower more reinforced portion of the swab cup.

One object of this invention is to provide a swab cup structure overcoming the aforementioned disadvantages of the prior art devices in alignment and permanent positioning of the support members or wires.

Still, another object of this invention is to provide a swab cup structure which has both short and long reinforcing members or wires in an alternating relation and in a spaced relation around the circumference of the swab cup for enabling the swab cup to pick up and transport relatively light well fluid loads and also heavier well fluid loads.

Various other objects, advantages and features of this invention will become apparent to those skilled in the art from the following discussion, taken in conjunction with the accompanying drawing.

DETAILED DESCRIPTION

Figure 1:
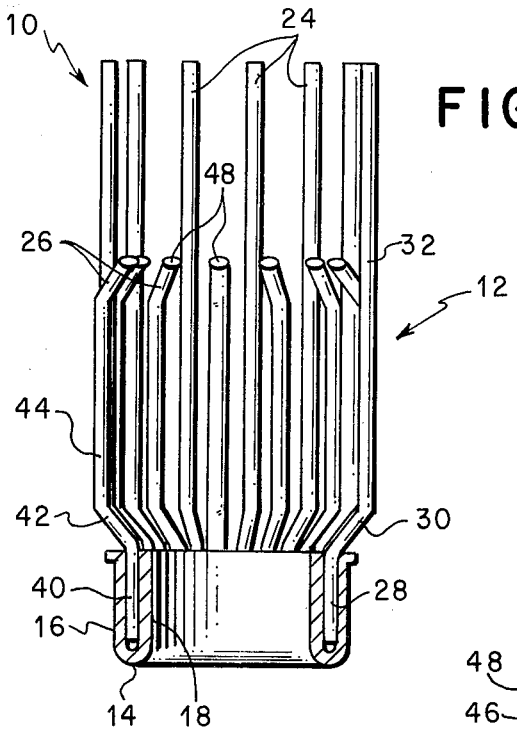
FIG. 1 is a cross-sectional side elevation view of the reinforcement structure taken at the location of line 1—1 in FIG. 2.
Figure 2:
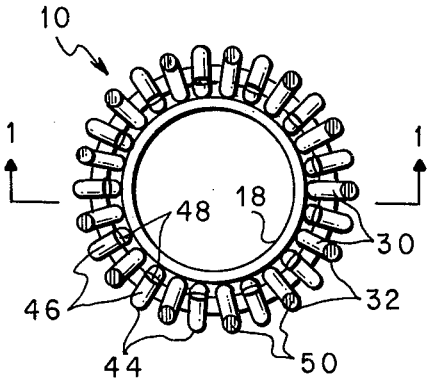
FIG. 2 is a top end view of the structure of FIG. 1.

Referring to FIGS. 1 and 2, the swab cup of this invention has a metal reinforcing structure or bushing 10 for use in supporting an elastomeric well swab cup body. Although the reinforcement structure is depicted as metal, it could be of any suitable strong material such as fiberglass or plastic.

Bushing 10 consists of a plurality of upwardly extending wires, indicated generally at 12, having one end rigidly secured inside a cross-sectionally U-shaped circular base cup 14. Wires 12 may have a circular cross-sectional shape or be of any other convenient configuration. This plurality of wires forms a generally cylindrical cage assembly that is the internal support of the swab cup.

The base cup 14 is preferably formed from a single annular piece of metal pressed or forged into the U-shaped configuration illustrated. The wires 12 are placed in the annular slot formed in the base cup 14, and the outer wall 16 may be swaged to hold the wires tightly in base cup 14. Alternatively, the inner wall 18 may be swaged outward to clamp the wires tightly.

After the wires have been clamped tightly in the base cup in a relatively equispaced relationship, the structure is then placed in a swab cup injection mold and positioned therein by means well-known in the art.

A viscous elastomeric material is then injected into the mold under sufficient heat and pressure to fill in all the spaces around wires 12 and base cup 14. After the elastomer sets up, it may be cured by well-known procedures and then finished to size.

Figure 3:
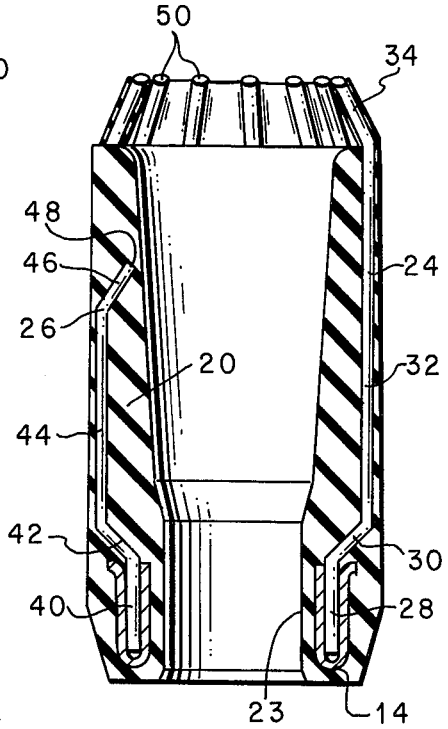
FIG. 3 is a cross-sectional view of a finished swab cup taken at the same location as FIG. 1.

FIG. 3 illustrates the finished swab cup having an elastomeric material 20 bonded therearound. A central bore passage 22 is provided through the swab cup to allow its placement on the swab mandrel. The group of wires 12 includes a plurality of longer wires 24 and a plurality of shorter wires 26 placed in an alternating relation around base cup 14.

Longer wires 24, as shown in FIG. 1, have a straight portion 28 of their lower end portion mounted within the annular slot opening of base cup 14, an outwardly disposed S-curved intermediate portion 30 and a straight upper portion 32. The upper end portion 34 of the longer wire straight upper portion 32 is inwardly curved in the finished swab cup shown in FIG. 3. Longer wires 24 are essentially completely enclosed within the major portion of the swab cup elastomeric body 20. The longer wires inwardly curved upper end portion 38 can be bare as shown in FIG. 3 or they can have a webb of elastomeric material therearound if desired.

Shorter wires 26 as shown in the drawing have a straight portion 40 mounted within the annular slot opening of base cup 14, an outwardly disposed S-curved lower intermediate portion 42, a straight upper intermediate portion 44 and an inwardly curved upper end portion 46. Straight upper intermediate portion 44 is substantially in circumferential alignment with longer wire straight upper portion 32. Shorter wires inwardly curved upper end portion 46 is curved such that the upper end 48 thereof is disposed at a mid-portion of the generally cylindrical wall of the swab cups elastomeric body 20 as shown in FIG. 3.

Shorter wires 26 are preferably selected to be a length that places their upper ends 48 in the range of between approximately one-half (½) to three-forths (¾) of the distance from the bottom of base cup 14 to the upper ends 50 of longer wire members 16 in the completed swab cup as shown in FIG. 3. This length for shorter wires 26 places them in position to sufficiently support or stiffen the swab cup's lower portion so it will pick up and carry or transport heavy well fluid loads. When this swab cup is transporting a relatively heavy well fluid load, it will deform through the major portion of its exterior in order to locate the outer portion of wires 12 in a juxtapositional relation to the well tubing interior. When this swab cup is transporting a relatively light well fluid load, it will deform radially outward at its upper portion because of the less stiff structure in order to locate the wires upper end portion alongside the well tubing inner wall surface. Because of this deformation of the swab cup's upper portion, the swab cup can pick up and transport light loads of well fluid that otherwise could not be picked up in a more rigid or stiffer construction.

Although a specific preferred embodiment of the present invention has been described in the detailed description above, the description is not intended to limit the invention to the particular forms of embodiments disclosed therein since they are to be recognized as illustrative rather than restrictive and it will be obvious to those skilled in the art that the invention is not so limited. For instance, whereas the use of individual wires are illustrated, it is clear that a single cylindrical tube could be used by cutting vertical slots through the wall to form upward extending tines and cutting alternating tines to form the shorter support members. Also, other means than swaging can be used to secure the wires in place in the base cup such as resins or so-called super glues like cyanomethacrylate. Other materials than metal can be used to form the wires and/or the base cup. Thus, the invention is declared to cover all changes and modifications of the specific example of the invention herein disclosed for purposes of illustration which do not constitute departures from the spirit and scope of the invention.

The embodiments of the invention in which an exclusive property or privilege is claimed are defined as follows:

1. An improved swab cup assembly comprising:

(a) a unitary base member of U-shaped cross-section formed from a single annular member to include an annular bottom portion having inner and outer peripheral edges and inner and outer wall portions from the respective inner and outer peripheral edges of said bottom portion, said wall portions extending in spaced, generally concentric parallel relationship forming an annular slot therebetween;

(b) a plurality of elongated wire members having straight lower end portions, S-shaped intermediate portions, and inwardly bent upper portions, said lower portions being disposed in said slot in circumferentially spaced relationship and in tight, frictional engagement with said wall portions whereby the lower end portions of said wire members are retained immobile with respect to said base member and each other;

(c) a portion of said wire members being shorter wire members that are substantially shorter than the other longer wire members, said shorter and said longer wire members being arranged in an alternating relation in placement around said base member; and (d) elastomeric means encapsulating said base member, said shorter wire members and lower and at least intermediate portions of each of said longer wire members for forming said base member and said wire members into an annular swab cup assembly.

2. The improved swab cup assembly of claim 1, wherein said shorter wire members terminate at a mid-portion of said longer wire members and said shorter wire members have unattached end portions thereof curved inwardly in their upper portion toward the longitudinal axis of said swab cup assembly.

3. The improved swab cup of claim 2, wherein said wires each consist of a single elongated wire element.

4. The improved swab cup of claim 2, wherein said shorter wire members are substantially in circumferential alignment with said longer wire elements through lower and mid-portions thereof with upper end portions of said shorter wires curving toward the longitudinal axis of said swab cup and with upper ends of said shorter wires being within a mid-portion of a wall formed around said wires by said elastomeric means.

5. The improved swab cup of claim 2, wherein said shorter wires have the upper ends thereof spaced a distance from said base member that is between one-half (½) to three-forths (¾) of the distance from said base member to the upper ends of said longer wire members.

* * * * *